US006910994B2

(12) United States Patent
Mitchell et al.

(10) Patent No.: US 6,910,994 B2
(45) Date of Patent: Jun. 28, 2005

(54) TRICEPS EXTENSION MACHINE

(75) Inventors: Gary Mitchell, Independence, VA (US); Gregory M. Webb, Independence, VA (US)

(73) Assignee: Nautilus Human Performance Systems, Inc., Independence, VA (US)

( * ) Notice: Subject to any disclaimer, the term of this patent is extended or adjusted under 35 U.S.C. 154(b) by 613 days.

(21) Appl. No.: 09/998,026

(22) Filed: Nov. 30, 2001

(65) Prior Publication Data

US 2002/0198087 A1 Dec. 26, 2002

Related U.S. Application Data

(60) Provisional application No. 60/299,677, filed on Jun. 20, 2001.

(51) Int. Cl.[7] ..... A63B 21/062; A63B 23/12
(52) U.S. Cl. ..... 482/100; 482/137; 482/142
(58) Field of Search ..... 482/93, 94, 97–100, 482/135–138; D21/676, 690

(56) References Cited

U.S. PATENT DOCUMENTS

| | | | | | |
|---|---|---|---|---|---|
| 4,722,522 | A | * | 2/1988 | Lundgren | 482/97 |
| 5,378,216 | A | * | 1/1995 | Ish et al. | 482/94 |
| 5,421,796 | A | * | 6/1995 | Jones et al. | 482/100 |
| 5,803,882 | A | * | 9/1998 | Habing et al. | 482/136 |
| 5,897,467 | A | * | 4/1999 | Habing et al. | 482/100 |
| 2002/0058572 | A1 | * | 5/2002 | Karasawa et al. | 482/99 |

FOREIGN PATENT DOCUMENTS

| | | | | |
|---|---|---|---|---|
| GB | 2223686 A | * | 4/1990 | A63B/21/22 |

OTHER PUBLICATIONS

"Time Machines" by Nautilus (Catalog 1972–1973), Compound Position Curl Machine, pp. A–22, A–23 and A–28.*
"Time Machines" by Nautilus (Catalog 1972–1973) Triceps p. A29.
Nautilus Catalog (1975) Triceps Machines.
Nautilus Instruction Manual (1982) Mens' Triceps pp. 44, 45 and 47.
Nautilus Equipment Catalogue (1984) Triceps Machine 3rd pg.
Nautilus The Next Generation (1989–1996) Mens' Multi–Triceps.
Nautilus 2st Super Smooth Technology (1996–present) Triceps; 2st Line.

* cited by examiner

*Primary Examiner*—Jerome W. Donnelly
*Assistant Examiner*—Victor K. Hwang
(74) *Attorney, Agent, or Firm*—Myers Bigel Sibley & Sajovec

(57) ABSTRACT

An exercise machine includes: a frame configured to rest on an underlying surface; a seat mounted to the frame and configured to receive a seated user; a pair of support pads mounted to the frame forwardly of and above the seat, each of the support pads being positioned to engage the upper arms and/or elbows of the seated user; a pair of movement arm units pivotally interconnected with the frame and movable about respective generally horizontal axes of rotation; and a resistance system connected with the movement arm units. Each of the pair of movement arm units is configured to engage the forearms and/or the hands of the user and is movable between a retracted position, in which the seated user's arms are bent, and an extended position, in which the user's arms are extended, the axes of rotation forming an angle of between about 115 and 155 degrees.

42 Claims, 8 Drawing Sheets

TRICEPS EXTENSION MACHINE

RELATED APPLICATION

This application claims priority from U.S. Provisional Patent Application No. 60/299,677, filed 20 Jun. 2001, entitled "Triceps Curl Machine."

FIELD OF THE INVENTION

The present invention relates generally to exercise machines, and more specifically to exercise machines that exercise the triceps muscles of a user.

BACKGROUND OF THE INVENTION

Exercise devices, and in particular weight training machines, typically include one or more mechanical members that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement for weight training is the "triceps extension" motion, in which an exerciser bends his arms at the elbow to grasp a handle or other grasping device, and straightens his arms while maintaining the upper arms or elbows in a substantially stationary position. This exercise movement tends to work the triceps muscles of the upper arms.

Some triceps extension machines include a frame that has a base and vertical uprights that rise from the base, a seat that is mounted to the frame, and a pair of movement arms that are pivotally mounted to and extend inwardly from the vertical uprights. Support pads for the user's elbows extend inwardly from the vertical uprights. The user sits on the seat, rests his elbows on the supports, grasps the movement arms with his arms bent, and extends his arms such that the movement arms pivot relative to the frame. This movement is resisted by weights or other resistance system.

In many triceps extension machines of this general configuration, planes defined by each vertical upright are generally parallel with one another. The axes of rotation of the movement arms tend to be substantially normal to these planes. As a result, the movement arms are positioned in front of a seated user. This configuration may be inconvenient for a user as he enters the machine; often the movement arm must be moved out of the way in order for the user to sit.

In addition, typically the user sits so that his elbows are at substantially the same height as his shoulders during exercise. However, in this configuration the user's elbows may tend to become disengaged with the supports they rest upon, which may reduce the effectiveness of the exercise.

SUMMARY OF THE INVENTION

The present invention is directed to a triceps extension machine that can enable a user to be seated more easily. The exercise machine includes: a frame configured to rest on an underlying surface; a seat mounted to the frame and configured to receive a seated user; a pair of support pads mounted to the frame above the seat, each of the support pads being positioned to engage one of the upper arms and the elbows of the seated user; a pair of movement arm units pivotally interconnected with the frame and movable about respective generally horizontal axes of rotation; and a resistance system connected with the movement arm units. Each of the pair of movement arm units is configured to engage the forearms and/or the hands of the user and is movable between a retracted position, in which the seated user's arms are bent, and an extended position, in which the user's arms are extended, the axes of rotation forming an angle of between about 115 and 155 degrees. The resistance system provides resistance to rotation of the movement arm units as they move from the retracted position to the extended position. In this configuration, the triceps extension machine may provide easier access to a user than prior triceps extension machines.

The present invention is also directed to a triceps extension exercise machine that can stabilize the elbows of the user during exercise. This aspect of the invention comprises: a frame configured to rest on an underlying surface; a seat mounted to the frame and configured to receive a seated user; a pair of support pads mounted to the frame above the seat, each of the support pads being positioned to engage one of the upper arms and the elbows of the seated user; a pair of movement arm units pivotally interconnected with the frame and movable about respective generally horizontal axes of rotation, each of the pair of movement arm units being configured to engage the forearms and/or the hands of the user, each of the pair of movement arm units being movable between a retracted position, in which the seated user's arms are bent, and an extended position, in which the user's arms are extended; and a resistance system connected with the movement arm units that provides resistance to rotation of the movement arm units as they move from the retracted position to the extended position. The elevations of the seat and the support pads are selected such that, when the user is seated and the user's upper arms or elbows engage the support pads, the user's upper arms are angled upwardly from shoulder to elbow at an angle of at least 10 degrees. In this configuration, the user's elbows tend to remain engaged with the support pads, thereby improving the effectiveness of the exercise.

As an additional aspect, the present invention is directed to a frame for an exercise machine that can provide easy access to the exerciser. Such a frame comprises: pairs of front and rear uprights rising from respective legs, each set of respective front and rear uprights and legs defining a generally vertical plane, the generally vertical planes defining an angle of between about 20 and 70 degrees; a seat mounted to the frame and configured to receive a seated user; and a pair of pads mounted to the frame above the seat, each of the pads being positioned to engage the upper arms of the seated user. The frame is adapted to receive a pair of movement arm units pivotally interconnected with the frame and movable about respective generally horizontal axes of rotation, each of the pair of movement arm units being configured to engage a portion of the arms or hands of the user, each of the pair of movement arm units being movable between a retracted position, in which the seated user's arms are bent, and an extended position, in which the user's arms are extended. A frame of this configuration may be used for either a triceps extension machine or a biceps curl machine.

DETAILED DESCRIPTION OF THE INVENTION

Figure 1:
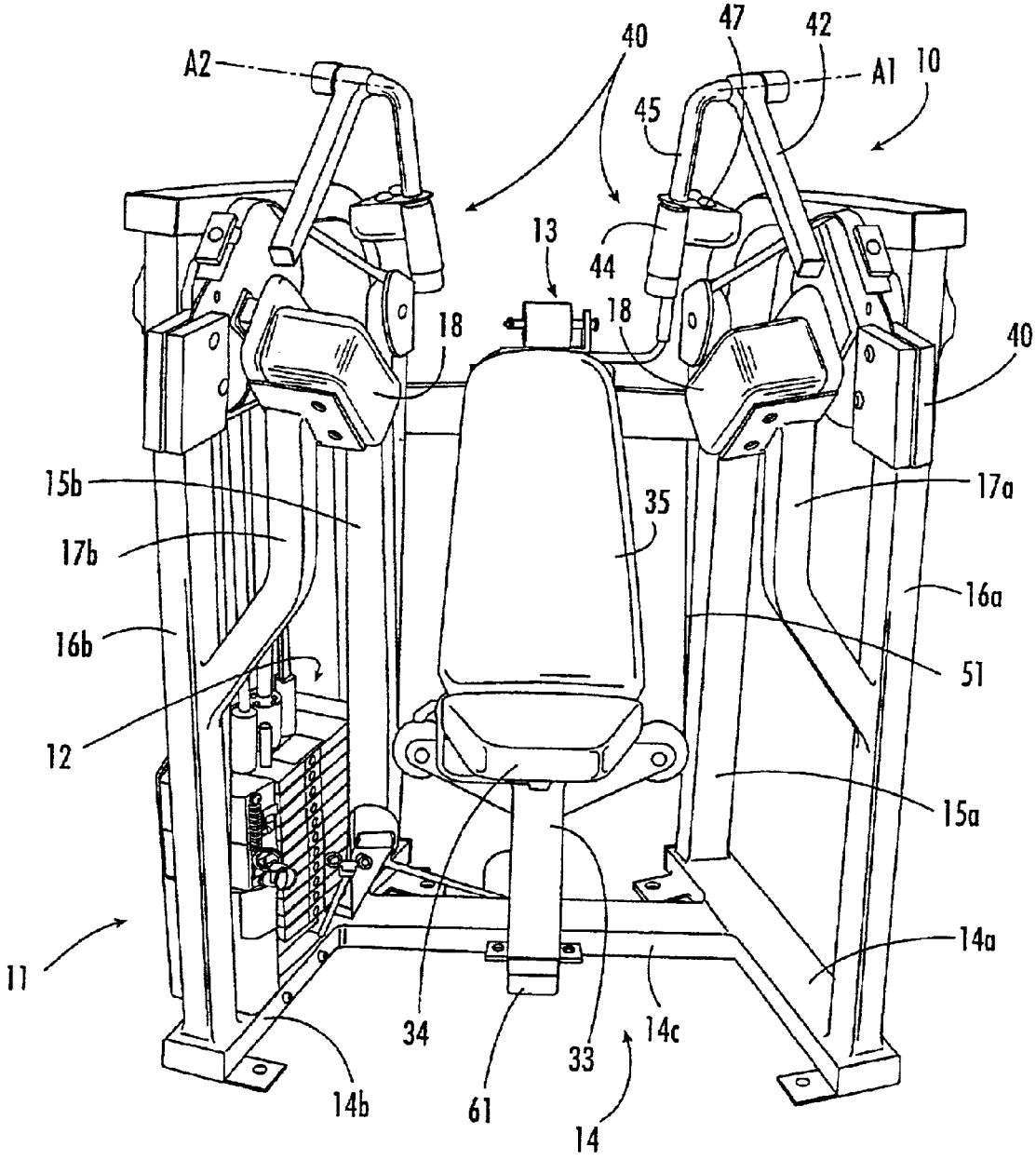
FIG. 1 is a perspective view of a triceps extension machine of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

A triceps extension machine, designated broadly at 10, is illustrated in FIGS. 1–7. The machine 10 includes a frame 11, a weight stack 12, a seat assembly 13, two movement arm units 40, and two pulley systems 50, 60. These components are described in more detail below.

Referring to FIGS. 1–3, 6 and 7, the frame 11 includes a base 14 with legs 14*a*, 14*b* and a cross member 14*c*, rear uprights 15*a*, 15*b* that extend upwardly and forwardly from rear portions of the legs 14*a*, 14*b*, and front uprights 16*a*, 16*b* that extend upwardly from front portions of the legs 14*a*, 14*b*. The rear and front uprights 15*a*, 16*a* define plane $P_1$ and the rear and front uprights 15*b*, 16*b* define a plane $P_2$. The planes $P_1$, $P_2$ form an angle $\alpha$ (see FIG. 6) of between about 20 and 70 degrees, with an angle $\alpha$ of between 35 and 45 degrees being preferred, and an angle $\alpha$ of about 40 degrees being most preferred. This angular arrangement can provide easy access into the machine for a user; as noted above, prior machines, particularly those that have frame arms and uprights that are parallel to one another, may require that the movement arm be raised in order for the user to be seated for exercise. A respective pad arm 17*a*, 17*b* extends inwardly and upwardly from each front upright 16*a*, 16*b* to terminate at a position below the horizontal portions of the rear uprights 15*a*, 15*b*. A support pad 18 is attached to the upper end of each pad arm 17*a*, 17*b* in position to engage the upper arms or elbows of the user. A seat mounting platform 33 is mounted to the forward edge of the cross member 14*c*.

Those skilled in this art will appreciate that the frame 11 may take alternative forms. For example, additional uprights may be employed, or certain components may be formed from multiple pieces. Further, those skilled in this art will recognize that the frame 11 may be suitable for use as part of a biceps curl machine, such as that described in co-assigned and co-pending U.S. patent application Ser. No. 09/998,039, entitled "Biceps Curl Machine" filed Nov. 30, 2001.

Figure 2:
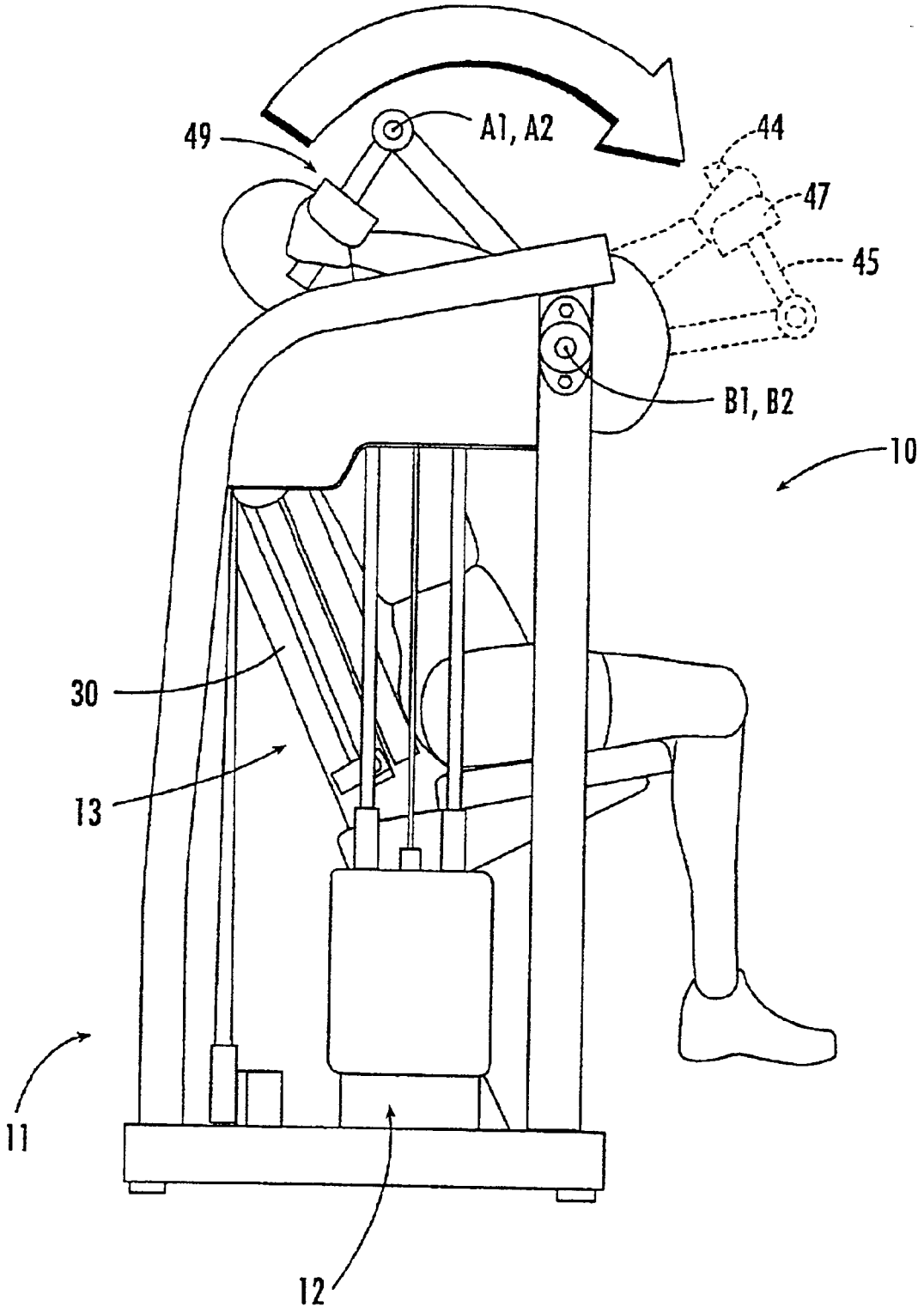
FIG. 2 is a side view of the machine of FIG. 1, with the retracted exercise position being shown in solid line, and the extended position being shown in phantom line.
Figure 3:
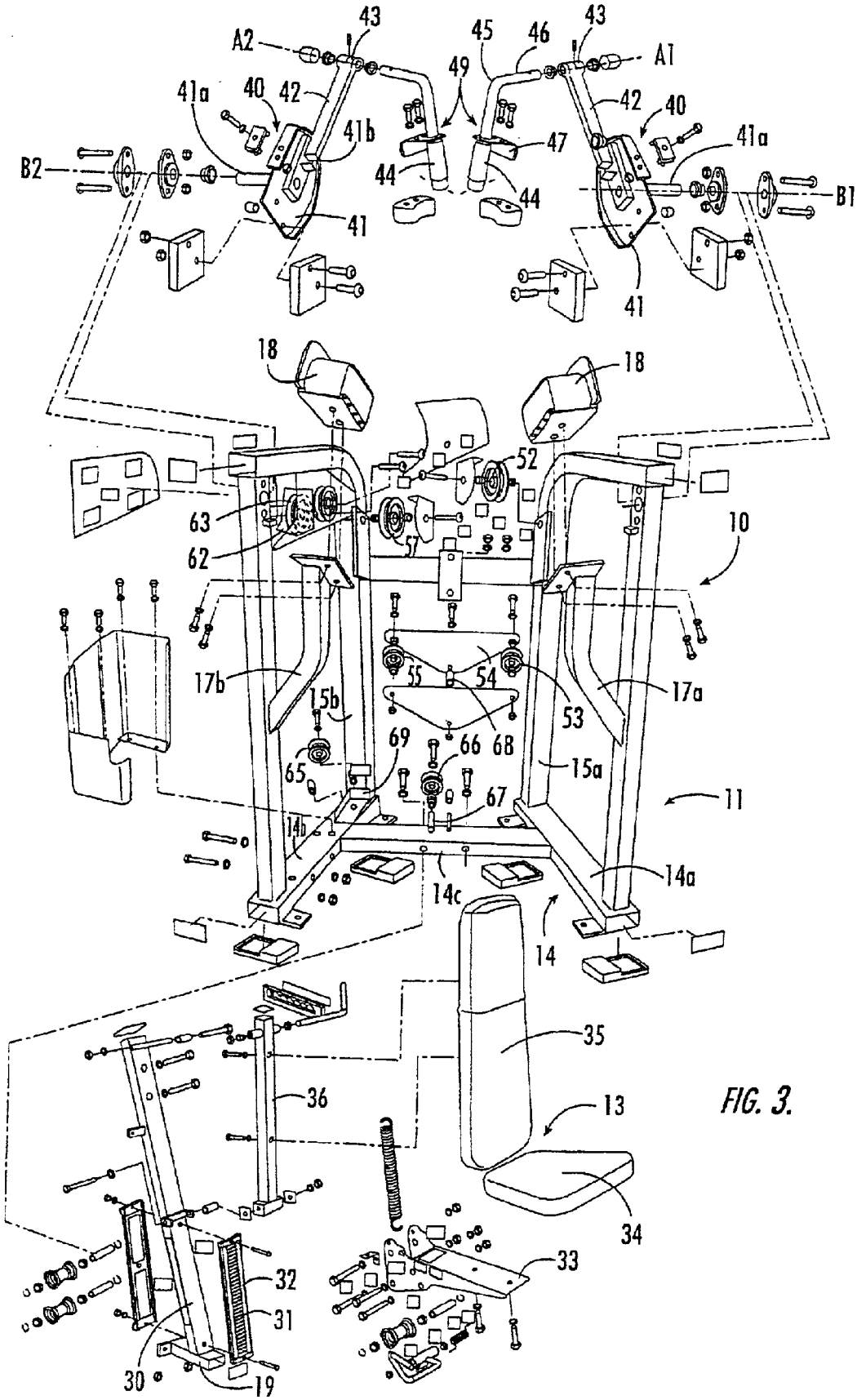
FIG. 3 is an exploded view of the frame, cam assemblies, handle assemblies, and seat assembly employed with the machine of the present invention.
Figure 4:
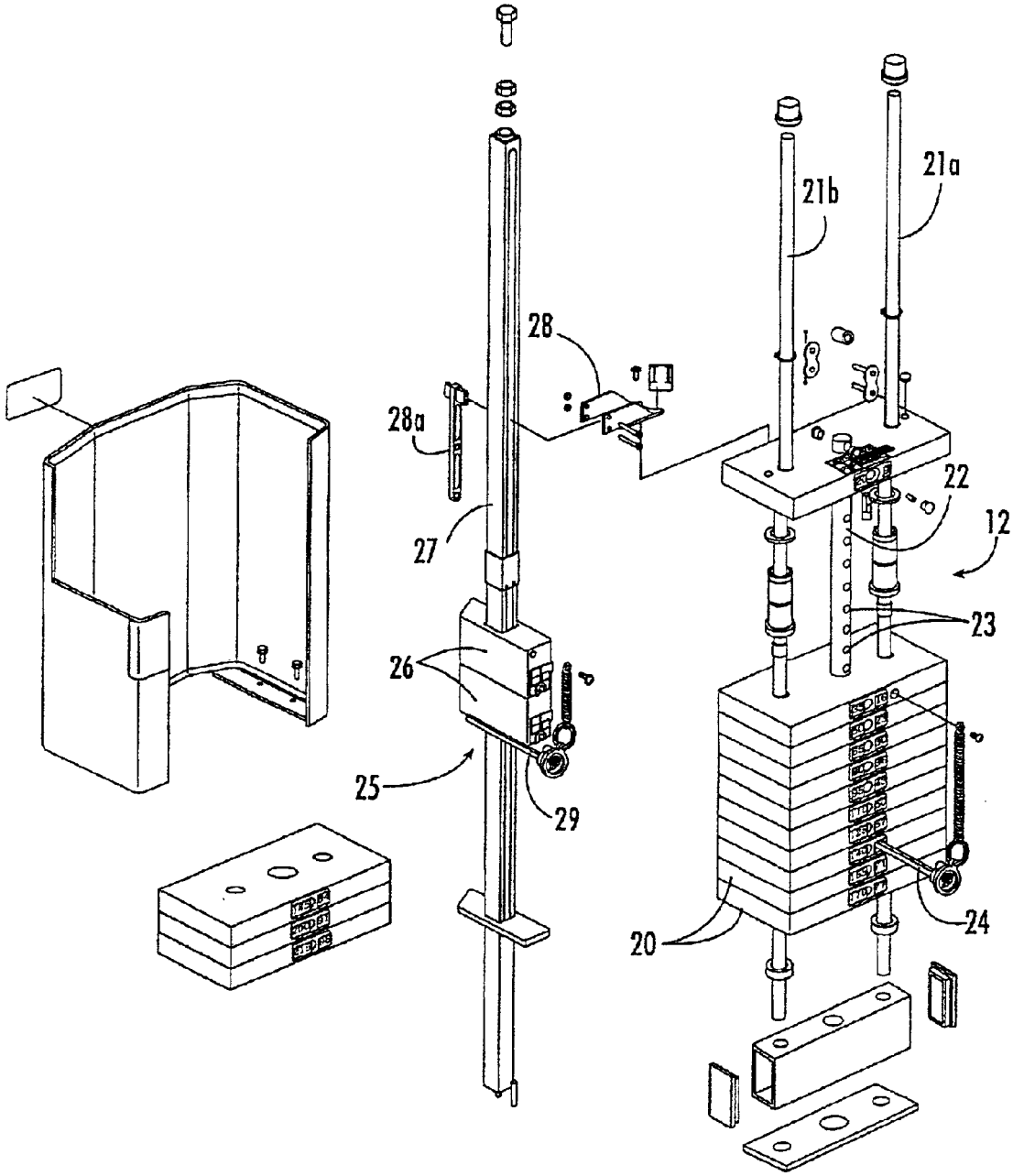
FIG. 4 is a perspective view of the weight stack employed with the machine of the present invention.

Referring now to FIGS. 1, 2 and 4, the weight stack 12 is positioned on the leg 14*b* and includes a plurality of weights 20 arranged in a vertical stack. Two guide rods 21*a*, 21*b* extend vertically from the leg 14*b* to the upper portion of the rear upright 15*b*; the weights 20 have apertures that receive the guide rods 21*a*, 21*b* such that the weights are free to slide vertically thereon. An elongate lifting member 22 extends through an aperture in the center of each weight 20. The lifting member 22 includes apertures 23 that can receive a pin 24. An auxiliary weight stack 25 includes a pair of lighter weights 26 that slide on a guide rod 27 that also extends from the leg 14*b* to the upper portion of the rear upright 15*b*. An auxiliary weight bracket 28 is attached to the uppermost weight 20 and to a stack pin 28*a* that fits within a groove in the guide rod 27 and includes apertures to receive a pin 29 for the selection of weights 26.

Those skilled in this art will appreciate that other resistance systems may be employed with the present invention. For example, other weight stack configurations, friction-imparting devices, variable viscosity devices, air drag-based resistance devices, and the like, may also be employed with a machine of the present invention. Exemplary resistance devices include those illustrated in U.S. Pat. Nos. 5,810,696; 4,708,338; 4,720,093; 5,033,733; 4,542,897; 4,298,893; 4,805,901; 4,790,528; 4,786,049; 5,031,900; 4,775,145; 4,589,656; and 4,659,074, the disclosures of each of which are hereby incorporated herein by reference in their entireties.

The seat assembly 13 includes a support member 30 that is mounted to the seat mounting platform 19 and extends upwardly and rearwardly therefrom. Preferably, the support member 30 reclines at an angle $\beta$ (FIG. 7) with the underlying surface that is between about 60 and 80 degrees, and more preferably between about 70 and 80 degrees, with 75 degrees being most preferred. A track 31 with a serrated front surface 32 is mounted to the front surface of the support member 30. A seat bracket 33 is mounted to the track 31 such that the rear edge thereof mates with one of the serrations in the track front surface 32. A seat 34 is mounted on the upper surface of the seat bracket 33. The interaction between the seat bracket 33 and the serrations in the track front surface 32 enable the seat 34 to be adjusted vertically to a number of discrete positions along the track 31. A backrest 35 is mounted to a backrest support 36, which is in turn mounted to the support member 30 above the seat 34; the reclining angle of the backrest support 36, and in turn the backrest 35, can be adjusted as desired.

Each of the movement arm units 40 is pivotally attached to the frame 11; only one movement arm unit 40 will be described in detail herein, as the movement arm units 40 are essentially mirror images of one another. A cam 41 is pivotally attached to an upper portion of each front upright 16*a*, 16*b* via a pivot pin 41*a* that extends through an aperture in a respective front upright 16*a*, 16*b*. The cam 41 has an upper camming surface 41*b*. A lever arm 42 extends upwardly and rearwardly from each cam 41 and terminates in a hollow, elongate sleeve bearing hubs 43. An L-shaped handle 49 includes a grip portion 44 that points generally downwardly and is gripped by the user's hand, a padded bearing surface 47 that is configured to be engaged by the user's hand or forearm, an intermediate portion 45 that merges with the grip portion 44, and a mounting portion 46 that is received within and pivots relative to the bearing 43. Thus, each handle 49 is free to pivot relative to its corresponding lever arm 42 about a respective generally horizontal axis of rotation A1, A2, and each cam 41 is free to pivot relative to its corresponding upright 16*a*, 16*b* about a respective axis of rotation B1, B2 that is substantially parallel with its corresponding axis of rotation A1, A2. Notably, the axis A1 defines an angle $\gamma$ (FIG. 6) which is between about 115 and 155 degrees with the axis A2, and more preferably is between 135 and 145 degrees, with 140 degrees being most preferred; consequently, the axis B1 forms a similar angle with the axis B2. Also, it is notable that the axes A1, A2 are substantially perpendicular to the respective planes $P_1$, $P_2$ defined by the arms 14*a*, 14*b* and their respective rear and front uprights 15*a*, 15*b*, 16*a*, 16*b*.

Figure 8:
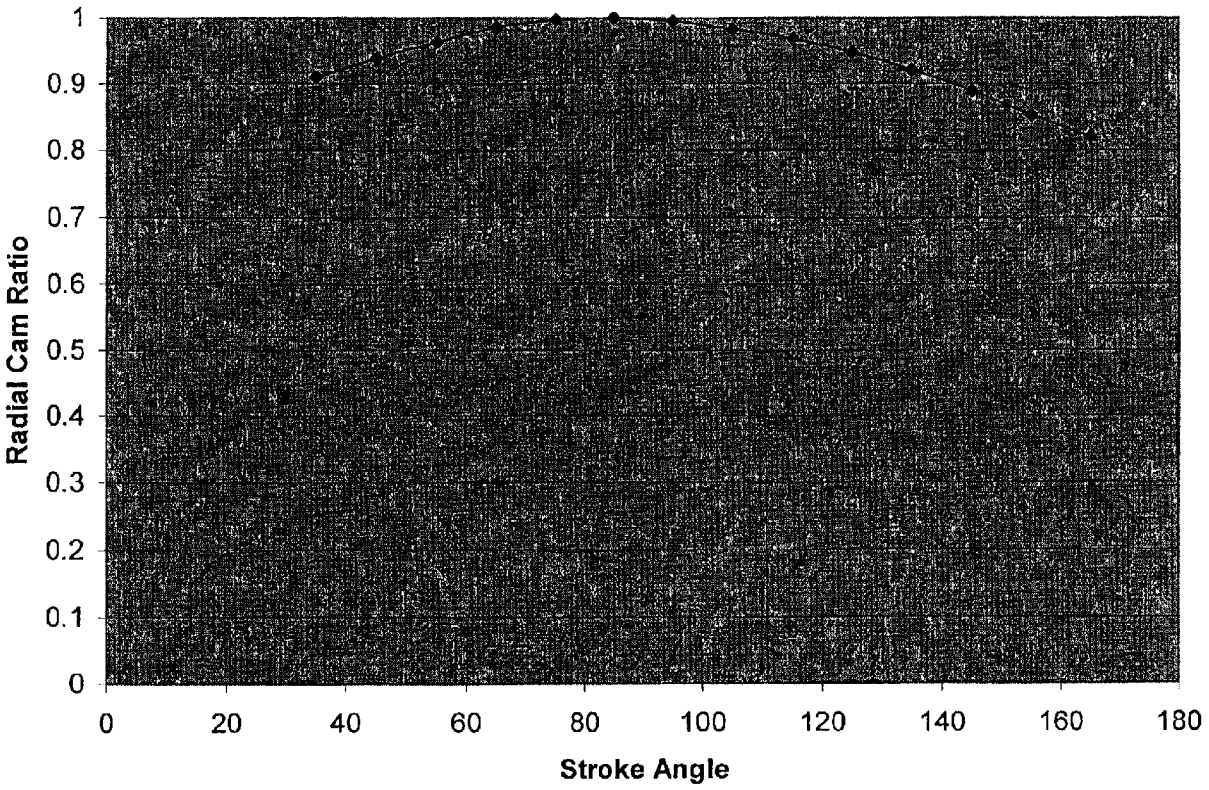
FIG. 8 is a graph plotting resistance as a function of cam angle for certain embodiments of the present invention.

The configuration of the camming surface 41*b* controls the resistance curve experienced by the user during exercise. Fundamentally, it is typically desirable to vary the resistance experienced by the user at different points during movement; otherwise, the magnitude of resistance necessary to provide a strengthening workout to a muscle or muscle group may be too high to enable the user to move the movement arm unit 40 through positions within the full range of motion in which the user enjoys a lower mechanical advantage. In the illustrated embodiment, the non-circular camming surface 41*b* of the cam 41 causes the resistance experienced by the user to follow the resistance curve illustrated in FIG. 8. Those skilled in this art will recognize that, although a non-circular cam is preferred to provide a varying resistance curve to the machine 10, other structures, such as four-bar linkages and the like, can also be employed to vary the resistance of the machine during exercise.

Figure 5:
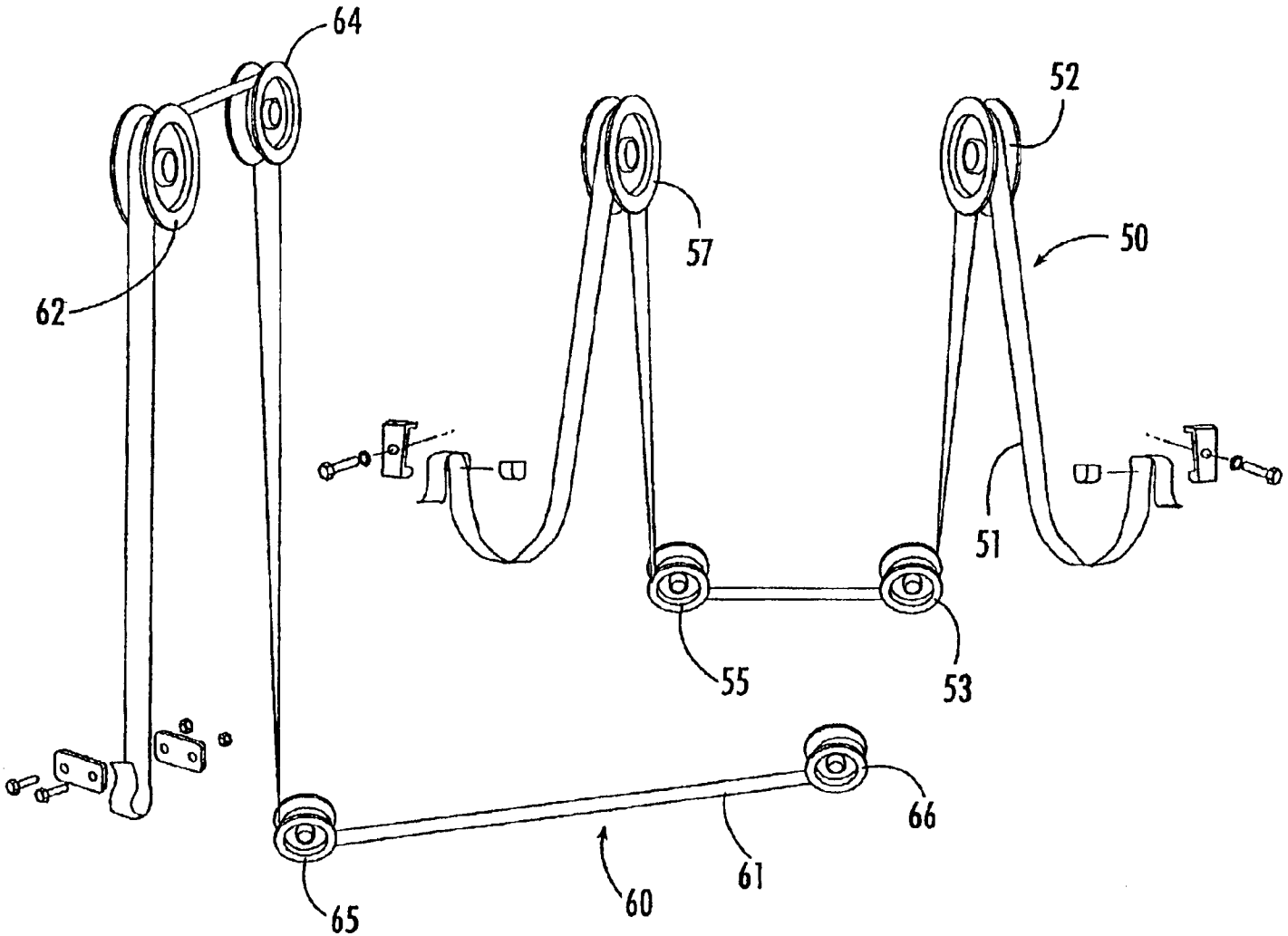
FIG. 5 is a schematic view of the belt-pulley system of the machine of the present invention.
Figure 6:
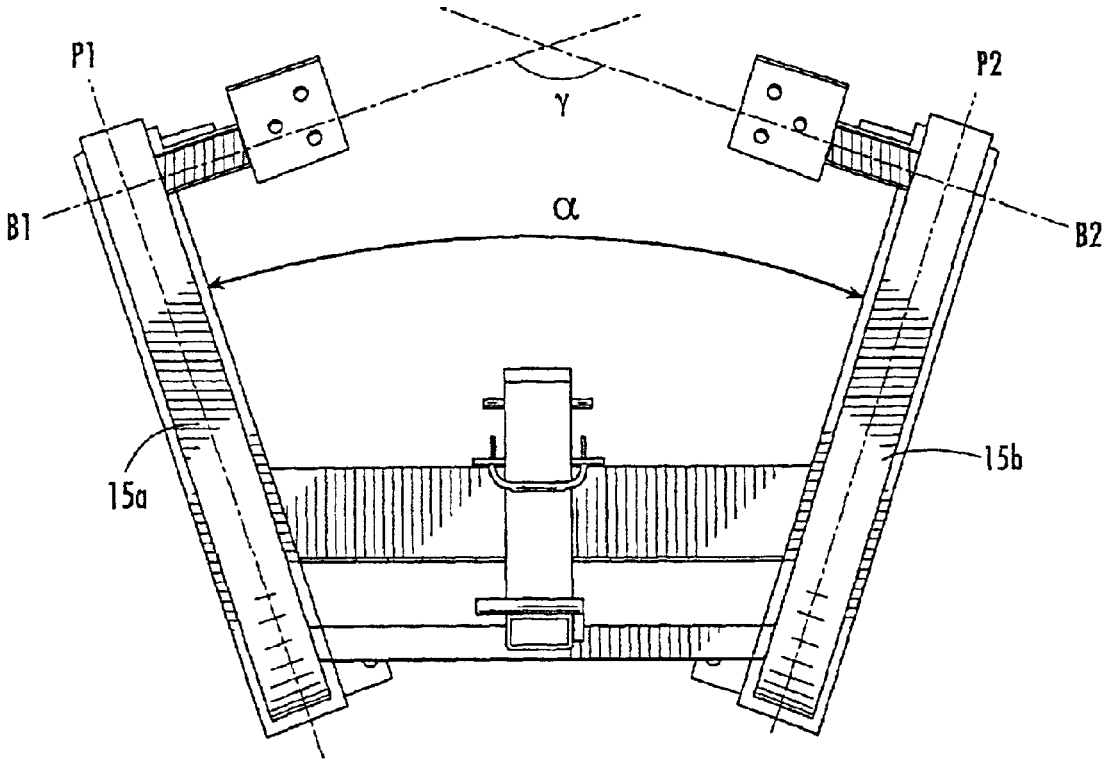
FIG. 6 is a partial top view of the frame of the machine of the present invention.
Figure 7:
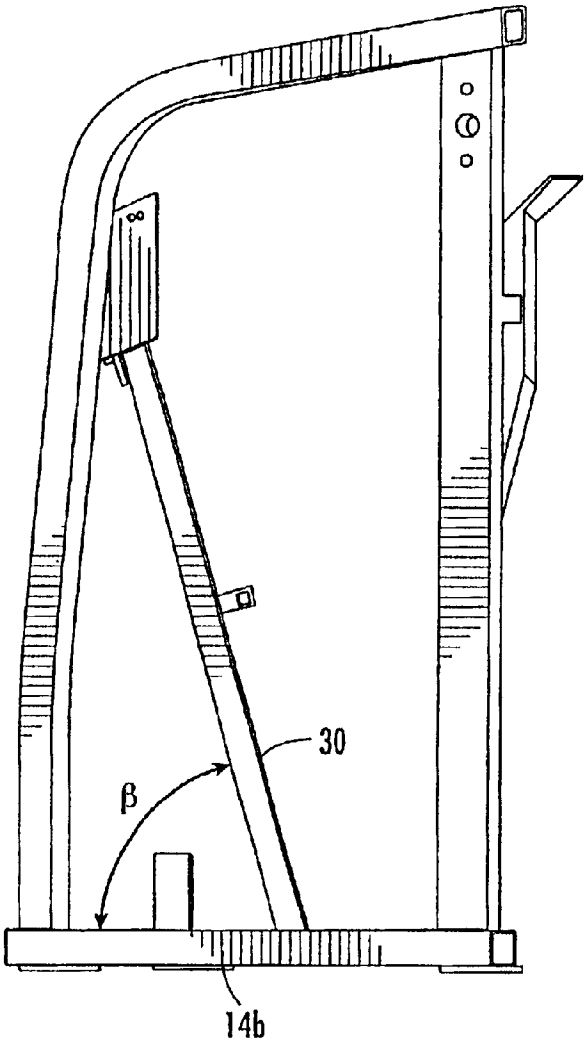
FIG. 7 is a partial side view of the frame and seat support member of the machine of the present invention.

The movement arm units 40 are interconnected with the weight stack 12 via two pulley systems 50, 60 (FIG. 5). The pulley system 50 includes a belt 51 that is attached to the forward portion of the perimeter of one cam 41. The belt 51 follows the contour of the upper camming surface 41*b* of the cam 41 as the belt 51 travels rearwardly, then extends downwardly to a pulley 52 mounted to an upper portion of one rear upright 15*a*, extends downwardly to a pulley 53 mounted to one end of a floating pulley bracket 54 (seen best in FIG. 3), extends horizontally to a pulley 55 mounted to the other end of the floating pulley bracket 54, extends upwardly to a pulley 57 mounted on the opposite rear upright 15*b*, and terminates by following the contour of the upper camming surface 41*b* of the other cam 41 and attaching to the forward perimeter portion thereof. The pulley system 60 includes a belt 61 that is attached to the lifting member 22 and extends upwardly over a pulley 62 attached to a forward portion of a pulley mounting bracket 63 attached to the upper portion of the frame 11, rearwardly to a pulley 64 attached to the rear portion of the pulley mounting bracket 63, downwardly to a pulley 65 attached to a bracket 69 attached to the lower end of the rear upright 15*b*, horizontally to a pulley 66 mounted via a pin 67 to the cross member 14*c*, and upwardly to fixedly mount to a pin 68 mounted to the lower central portion of the floating pulley mounting bracket 54.

Those skilled in this art will recognize that, although the pulley systems 50, 60 are employed to interconnect the weight stack 12 and the movement arm units 40, other systems that connect the movement arm units and the chosen resistance system, such as cables, chains, and the like, may be suitable for use with the present invention.

In operation, the user selects a desired weight by inserting the pin 24 into an aperture in the individual weight 20 that provides the user with a stack of weights 20 that corresponds to the desired exercise resistance (and, if desired, inserts the pin 29 to select one or both auxiliary weights 26). The user then adjusts the seat assembly 13 to the desired height (preferably one in which the user's elbows align with the axes of rotation B1, B2) by manipulating the seat 34 until the seat bracket 33 mates with a desired serration 31 on the track front surface 32. The user may also adjust the angle of the backrest 35. The user then sits upon the seat 34, rests his back against the backrest 35, grasps the grip portions 44 of the handles 49, and places his elbows on the pads 18 with his arms bent at the elbow (see FIG. 2). In this retracted position, the lever arm 42 extends upwardly and rearwardly from the cam 41, and the grip portion 44 of the handle 49 extends downwardly and rearwardly from the bearing hub 43. It is preferred that the user be seated at a height such that the user's upper arms are angled upwardly from shoulder to elbow; an angle of at least 5 degrees is preferred, with an angle of at least 10 degrees being more preferred. This posture tends to stretch the user's latissimus dorsi and the triceps, thereby increasing the range of motion and stabilizing the position of the elbows during the exercise movement, which is intended to work the triceps.

Exercise is performed by the user straightening his arms at the elbows and pressing on the bearing surfaces 47, thereby driving the grip portions 44 of the handles 49 away from his shoulders to an extended position (see FIG. 2 in phantom line). Doing so causes the cams 41 to pivot relative to the rear uprights 15*a*, 15*b* and take up some of the belt 51 on their camming surfaces 41*b* (when viewed from the right side of the user, both cams 41 pivot clockwise). As the cams 41 take up the belt 51, the shortening of the belt 51 causes the floating pulley bracket 54 to rise, which in turn draws the end of the belt 61 attached to the pin 68 of the floating pulley bracket 54 upwardly. As the end of the belt 61 rises, it draws the selected weights 20 in the weight stack 12 upwardly, thereby providing resistance to the user. Once the user has straightened his arms, he bends them at the elbow to return the movement arm units 40, the weights 20, and the pulley systems 50, 60 to their original positions.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An exercise machine for exercising the triceps muscles of a user, comprising:

a frame configured to rest on an underlying surface;

a seat mounted to the frame and configured to receive a seated user;

a pair of support pads mounted to the frame above the seat, each of the support pads being positioned to engage one of the upper arms and the elbows of the seated user;

a pair of movement arm units pivotally interconnected with the frame and movable about respective generally horizontal axes of rotation that extend through the seated user's elbows, each of the pair of movement arm units being configured to engage at least one of the forearms and the hands of the user, each of the pair of movement arm units being movable between a retracted position, in which the seated user's arms are bent, and an extended position, in which the user's arms are extended, the axes of rotation forming an angle of between about 115 and 155 degrees; the axes of rotation remaining stationary as the movement arms move between the retracted and extended positions; and a resistance system connected with the movement arm units that provides resistance to rotation of the movement arm units as they move from the retracted position to the extended position.

2. The exercise machine defined in claim 1, wherein the seat and frame are configured such that the elevation of the seat relative to the frame is adjustable.

3. The exercise machine defined in claim 2, wherein the seat elevation is adjustable such that, when the user is seated and the user's upper arms or elbows engage the support pads, the user's upper arms are angled upwardly from shoulder to elbow.

4. The exercise machine defined in claim 3, wherein the user's upper arms are angled upwardly from shoulder to elbow at an angle of at least 10 degrees.

5. The exercise machine defined in claim 1, further comprising a backrest positioned rearwardly of and extending upwardly from the seat, the backrest defining a plane that forms an angle of between about 60 and 80 with the underlying surface.

6. The exercise machine defined in claim 1, wherein each of the support pads is positioned so that each of the user's elbows is located on a respective axis of rotation.

7. The exercise machine defined in claim 1, wherein the angle formed by the axes of rotation is between 135 and 145 degrees.

8. The exercise machine defined in claim 1, wherein the frame includes pairs of front and rear uprights rising from respective legs, each set of respective front and rear uprights and legs defining a generally vertical plane, the generally vertical planes defining an angle of between about 20 and 70 degrees.

9. The exercise machine defined in claim 8, wherein the generally vertical planes define an angle of between about 35 and 45 degrees.

10. The exercise machine defined in claim 9, wherein each movement arm unit comprises a cam that pivots about its respective axis of rotation, and wherein the resistance system includes a belt attached to and engaging each cam.

11. The exercise machine defined in claim 10, wherein each movement arm unit comprises a lever arm attached to each cam and a handle that is pivotally interconnected to the lever arm and engages one of the forearm and hand of the user, the axis of rotation of the handle relative to the lever arm being substantially parallel to the axis of rotation of the cam relative to the frame.

12. The exercise machine defined in claim 1, wherein the resistance system comprises a weight stack.

13. An exercise machine for exercising the triceps muscles of a user, comprising:

a frame configured to rest on an underlying surface that includes pairs of front and rear uprights rising from respective legs, each set of respective front and rear uprights and legs defining a generally vertical plane, the generally vertical planes defining an angle of between about 20 and 70 degrees;

a seat mounted to the frame and configured to receive a seated user;

a pair of pads mounted to the frame above of the seat, each of the pads being positioned to engage the upper arms of the seated user;

a pair of movement arm units pivotally interconnected with the frame and movable about respective generally horizontal axes of rotation that extend through the seated user's elbows, each of the pair of movement arm units, being configured to engage at least one of the forearms and the hands of the user, each of the pair of movement arm units being movable between a retracted position, in which the seated user's arms are bent, and an extended position, in which the user's arms are extended, the axes of rotation remaining stationary as the movement arms move between the retracted and extended positions; and a resistance system connected with the movement arm units that provides resistance to rotation of the movement arm units as they move from the retracted position to the extended position.

14. The exercise machine defined in claim 13, wherein the angle between the generally vertical planes is between about 35 and 45 degrees.

15. The exercise machine defined in claim 13, wherein the angle between the axes of rotation is between about 135 and 145 degrees.

16. The exercise machine defined in claim 13, wherein the seat and frame are configured such that the elevation of the seat relative to the frame is adjustable.

17. The exercise machine defined in claim 16, wherein the seat elevation is adjustable such that, when the user is seated and the user's upper arms or elbows engage the support pads, the user's elbows are angled upwardly from shoulder to elbow.

18. The exercise machine defined in claim 16, wherein the user's elbows are angled upwardly from shoulder to elbow at an angle of at least 5 degrees.

19. The exercise machine defined in claim 13, further comprising a backrest positioned rearwardly of and extending upwardly from the seat, the backrest defining a plane that forms an angle of between about 60 and 80 degrees with an underlying surface.

20. The exercise machine defined in claim 13, wherein each of the support pads is positioned so that each of the user's elbows is located on a respective axis of rotation.

21. The exercise machine defined in claim 13, wherein the resistance system comprises a weight stack.

22. The exercise machine defined in claim 21, wherein each movement arm unit comprises a cam that pivots about its respective axis of rotation, and wherein the resistance system includes a belt attached to and engaging each cam.

23. The exercise machine defined in claim 22, wherein each movement arm unit comprises a lever arm attached to each cam and a handle that is pivotally interconnected to the lever arm and engages one of the forearm and hand of the user, the axis of rotation of the handle relative to the lever arm being substantially parallel to the axis of rotation of the cam relative to the frame.

24. An exercise machine for exercising the triceps muscles of a user, comprising:

a frame configured to rest on an underlying surface;

a seat mounted to the frame and configured to receive a seated user;

a pair of support pads mounted to the frame above the seat, each of the pads being positioned to engage the upper arms of the seated user;

a pair of movement arm units pivotally interconnected with the frame and movable about respective axes of rotation, that extend through the seated user's elbows, each of the pair of movement arm units being configured to engage at least one of the forearms and the hands of the user, each of the pair of movement arm units being movable between a retracted position, in which the seated user's arms are bent, and an extended position, in which the user's arms are extended, the axes of rotation forming an angle of between about 115 and 155 degrees, the axes of rotation remaining stationary as the movement arms move between the retracted and extended positions;

a weight stack;

a first belt connected with the movement arms;

a second belt connected with the weight stack; and a pulley bracket, the pulley bracket having a pair of upper pulleys that engage the first belt, the second belt being attached to the pulley bracket;

the weight stack, first and second belts, and pulley bracket being configured such that the weight stack resists movement of the movement arm units from the retracted position to the extended position.

25. The exercise machine defined in claim 24, wherein the seat and frame are configured such that the elevation of the seat relative to the frame is adjustable.

26. The exercise machine defined in claim 25, wherein the seat height is adjustable such that, when the user is seated and the user's upper arms or elbows engage the support pads, the user's elbows are angled upwardly from shoulder to elbow.

27. The exercise machine defined in claim 26, wherein the user's elbows are angled upwardly from shoulder to elbow at an angle of at least 5 degrees.

28. The exercise machine defined in claim 24, further comprising a backrest positioned rearwardly of and extending upwardly from the seat, the backrest defining a plane that forms an angle of between about 60 and 80 with degrees an underlying surface.

29. The exercise machine defined in claim 24, wherein each of the support pads is positioned so that each of the user's elbows is located on a respective axis of rotation.

30. The exercise machine defined in claim 24, wherein the angle formed by the axes of rotation is between 135 and 145 degrees.

31. The exercise machine defined in claim 24, wherein the frame includes pairs of front and rear uprights rising from respective legs, each set of respective front and rear uprights and legs defining a generally vertical plane, the generally vertical planes defining an angle of between about 20 and 70 degrees.

32. The exercise machine defined in claim 24, wherein each movement arm unit comprises a cam that pivots about its respective axis of rotation, a lever arm attached to the cam, and a handle that is pivotally interconnected to the lever arm and engages one of the forearm and hand of the user, the axis of rotation of the handle relative to the lever arm being substantially parallel to the axis of rotation of the cam relative to the frame.

33. An exercise machine for exercising the triceps muscles of a user, comprising:

a frame configured to rest on an underlying surface;

a seat mounted to the frame and configured to receive a seated user;

a pair of support pads mounted to the frame above the seat, each of the support pads being positioned to engage one of the upper arms and the elbows of the seated user;

a pair of movement arm units pivotally interconnected with the frame and movable about respective generally horizontal axes of rotation that extend through the seated user's elbows, each of the pair of movement arm units being configured to engage at least one of the forearms and the hands of the user, each of the pair of movement arm units being movable between a retracted position, in which the seated user's arms are bent, and an extended position, in which the user's arms are extended, the axes of rotation remaining stationary as the movement arms move between the retracted and extended positions; and a resistance system connected with the movement arm units that provides resistance to rotation of the movement arm units as they move from the retracted position to the extended position;

wherein the elevations of the seat and the support pads are selected such that, when the user is seated and the user's upper arms or elbows engage the support pads, the user's upper arms are angled upwardly from shoulder to elbow at an angle of at least 5 degrees.

34. The exercise machine defined in claim 33, further comprising a backrest positioned rearwardly of and extending upwardly from the seat, the backrest defining a plane that forms an angle of between about 60 and 80 degrees with the underlying surface.

35. The exercise machine defined in claim 33, wherein each of the support pads is positioned so that each of the user's elbows is located on a respective axis of rotation.

36. The exercise machine defined in claim 33, wherein the resistance system comprises a weight stack.

37. The exercise machine defined in claim 36, wherein each movement arm unit comprises a cam that pivots about its respective axis of rotation, and wherein the resistance system includes a belt attached to and engaging each cam.

38. The exercise machine defined in claim 37, wherein each movement arm unit comprises a lever arm attached to each cam and a handle that is pivotally interconnected to the lever arm and engages one of the forearm and hand of the user, the axis of rotation of the handle relative to the lever arm being substantially parallel to the axis of rotation of the cam relative to the frame.

39. A frame for an exercise machine for exercising the arm muscles of a user, comprising:

pairs of front and rear uprights rising from respective legs, each set of respective front and rear uprights and legs defining a generally vertical plane, the generally vertical planes defining an angle of between about 20 and 70 degrees;

a seat mounted to the frame and configured to receive a seated user; and a pair of pads mounted to the frame above the seat, each of the pads being positioned to engage the upper arms of the seated user;

the frame adapted to receive a pair of movement arm units pivotally interconnected with the frame and movable about respective generally horizontal axes of rotation that extend through the seated user's elbows, each of the pair of movement arm units being configured to engage a portion of the arms or hands of the user, each of the pair of movement arm units being movable between a retracted position, in which the seated user's arms are bent, and an extended position, in which the user's arms are extended, the axes of rotation remaining stationary as the movement arms move between the retracted and extended positions.

40. The exercise machine defined in claim 39, wherein the angle between the generall vertical planes is between about 35 and 45 degrees.

41. The exercise machine defined in claim 39, wherein the elevations of the seat and the support pads are selected so that the upper arms of the user are angled upwardly from the shoulder to the elbow when the user is in a seated position with his arms engaging the support pads.

42. The exercise machine defined in claim 41, wherein the upper arms of the user extend upwardly from the shoulder to the elbow at an angle of at least 5 degrees.

* * * * *

UNITED STATES PATENT AND TRADEMARK OFFICE

CERTIFICATE OF CORRECTION

PATENT NO. : 6,910,994 B2
DATED : June 28, 2005
INVENTOR(S) : Mitchell et al.

It is certified that error appears in the above-identified patent and that said Letters Patent is hereby corrected as shown below:

Column 9,
Line 25, should read -- forms an angle of between about 60 and 80 degrees with an --.

Signed and Sealed this

Twenty-ninth Day of November, 2005

JON W. DUDAS
*Director of the United States Patent and Trademark Office*